United States Patent [19]

Alderman

[11] 3,969,863

[45] July 20, 1976

[54] ROOF SYSTEM

[76] Inventor: Robert J. Alderman, Rte. 1, Box 205E, Ruskin, Fla. 33570

[22] Filed: Aug. 2, 1974

[21] Appl. No.: 494,097

[52] U.S. Cl. ..... 52/407; 52/90; 52/478; 52/488; 52/665; 52/743; 52/748

[51] Int. Cl.[2] ..... E04B 2/28; E04B 2/60; E04F 21/00

[58] Field of Search ..... 52/22, 90, 404, 407, 52/90, 478, 665, 262, 748, 743, 359, 488

[56] References Cited

UNITED STATES PATENTS

| | | | |
|---|---|---|---|
| 662,228 | 11/1900 | Escher | 52/484 X |
| 1,414,332 | 4/1922 | Hartmann | 52/407 |
| 1,595,718 | 8/1926 | Graham et al. | 52/359 |
| 2,239,394 | 4/1941 | MacKechnie | 52/407 |
| 2,335,968 | 12/1943 | Sawtell | 52/743 |
| 2,424,410 | 7/1947 | Miles | 52/748 X |
| 3,488,905 | 1/1970 | Campbell | 52/404 X |
| 3,513,614 | 5/1970 | Studzinski | 52/743 |
| 3,559,914 | 2/1971 | Alderman | 242/86.52 |

FOREIGN PATENTS OR APPLICATIONS

| | | | |
|---|---|---|---|
| 73,653 | 11/1953 | Netherlands | 52/404 |
| 1,028,906 | 5/1966 | United Kingdom | 52/90 |

*Primary Examiner*—Alfred C. Perham
*Attorney, Agent, or Firm*—Jones, Thomas & Askew

[57] ABSTRACT

A roof structure is fabricated by forming a lattice of support straps between the inclined rafters and the purlins, supporting one or more reels of insulation material on adjacent pairs of purlins with the width of the material spanning the space between the purlins, moving the reels along the lengths of the purlins and paying out the insulation material from the reels down into the spaces between the purlins and onto the lattice of support straps. Additional insulation material is applied to the upper surfaces of the purlins. The workmen follow the reels of insulation material and connect the hard roofing material over the insulation material to the purlins to complete the roof structure.

8 Claims, 5 Drawing Figures

ROOF SYSTEM

BACKGROUND OF THE INVENTION

Roof structures of industrial buildings typically comprise roof or rafter beams which extend parallel to one another across the building in one direction and purlins mounted on the rafters which extend parallel to one another in directions normal to the rafters. Insulation material is spread in long sheets or strips over the purlins with the lengths of the sheets extending normal to the lengths of the purlins, and hard roofing material is attached to the purlins through the insulating material. In the past, roof structures of this type have been difficult to assemble, and since the seams of abutting sheets of insulating material are usually exposed to the inside of the building structure, any gaps appearing in the seams are exposed within the building structure and air within the building contacts the hard roofing material, causing heat loss and vapor condensation.

The typical construction process for a roof structure includes the steps of unreeling sheets of insulation material from large reels of insulation material and placing the sheets of material with their lengths extending across the lengths of the purlins. The sheets of insulation material are stretched to prevent sagging between the purlins, and the hard roofing material is then placed over the insulation material and connected to the purlins. The hard roofing material is used as the working surface for the workmen and the reels of insulation material are unwound on this working surface and then moved by hand over to the exposed purlins adjacent the hard roofing material. With this procedure, poor alignment of the sheets of insulation material is likely to occur and gaps between adjacent sheets of insulation material are likely to be formed.

Because of the likelihood of gaps occurring between the adjacent sheets of insulation material, some manufacturers have produced insulation material with tapes that overhang the edges of the insulation material and which would normally overlap an adjacent sheet of insulation material in the roof structure. Also, rolls of tape, glue, and other devices have been developed for connecting together the abutting edges of insulation material in a roof structure to prevent gaps from appearing between adjacent strips of material. However, it is expensive and onerous for the workmen to seal the gaps with the use of these devices. Furthermore, since the strips of insulation material must be stretched to prevent sagging between the purlins, the workmen usually extend the strips of insulation material beyond the edges of the building structure so as to leave enough material available for the workmen to pull on and to stretch the material. After the strips of insulation material have been stretched, the overhanging edge portions must be cut away and discarded as waste.

As the typical roof structure is formed, it is customary to form the entire width of the roof structure at one time, proceeding along the length of the structure from one end to the other. This method of construction has been desirable since the insulation material comes in strips or long sheets and it has been convenient for the workmen to place the long sheets across the lengths of the purlins and immediately place the hard roofing material over the insulation material in their progression along the lengths of the purlins; however, the workmen are required to move back and forth across the width of the building and carry and retrieve their various manual and electrically actuated tools with them. Furthermore, the long lengths of insulation material are difficult to handle as it is being unreeled from its reels and moved onto the purlins from the surface of the hard roofing material. While the long sheets of insulation material are difficult to handle on a still day, they are extremely difficult to handle on a windy day—so much so that it is virtually impossible to handle the material. Of course, the wind factor also effects the neatness of the job, the number of gaps in the seams of the insulation material, the warping or stretching of the material, the number of workmen required to lay the material, and the safety of the workmen.

As set forth in U.S. Pat. No. 3,559,914, I have developed an improved roof structure and a system for applying insulation to the structure wherein the reels of insulation material are supported by adjacent ones of the purlins and the insulation material is paid out from the reels along the purlins instead of across the purlins. The insulation material spans the spaces between adjacent ones of the purlins and the edges of the strips of material extend along the upper surfaces of the purlins and are hidden from view. Support frames are provided for holding the reels of insulation material on the purlins and the support frames are pushed along the length of the purlins progressively across the roof structure as the sheets of hard roofing material are applied to the roof structure.

While my new system has met with substantial commercial success, there is also a need for heavily insulated roof structures in colder climates. When the thickness of the insulation material between the purlins and the hard roofing surface is increased, the hard roofing material tends to "work" with respect to the purlins and insulation material as the hard roofing material expands and contracts due to increases and decreases in its temperature, and as it moves in response to wind forces. Moreover, as the thickness of the insulation material between the purlins and the hard roofing surface increases, it is more difficult to attach the hard roofing surface to the purlins through the insulation material.

SUMMARY OF THE INVENTION

Briefly described, the present invention comprises a roof system wherein a lattice of support straps are positioned between the rafters and the purlins, thick insulation material is placed on the lattice of support straps between the purlins, and the hard roofing material is attached to the purlins over the insulation material. In addition, relatively narrow strips of insulation material are applied to the upper surfaces of the purlins, between the purlins and the hard roofing material, to minimize the transfer of heat from the hard roofing material to the purlins. The lattice of support straps rests on the rafters, and some of the support straps can be connected to the purlins, as may be desirable in the particular roof structure. The insulation material is applied to the roof structure by mounting reels of insulation material on support frames and moving the support frames along the length of the purlins and unreeling or paying out the insulation material from the reels as the frames are moved. One or more layers of insulation material can be applied between the purlins, as may be desired.

Thus, it is an object of the present invention to provide a roof structure that is attractive, inexpensive to construct, and which provides good insulation from heat and cold.

Another object of this invention is to provide an improved method of applying a roof structure to an industrial building, or the like, wherein the structure is expediently, safely and inexpensively formed.

Other objects, features and advantages of the present invention will become apparent upon reading the following specification, when taken in conjunction with the accompanying drawing.

DESCRIPTION OF AN EMBODIMENT

Figure 1:
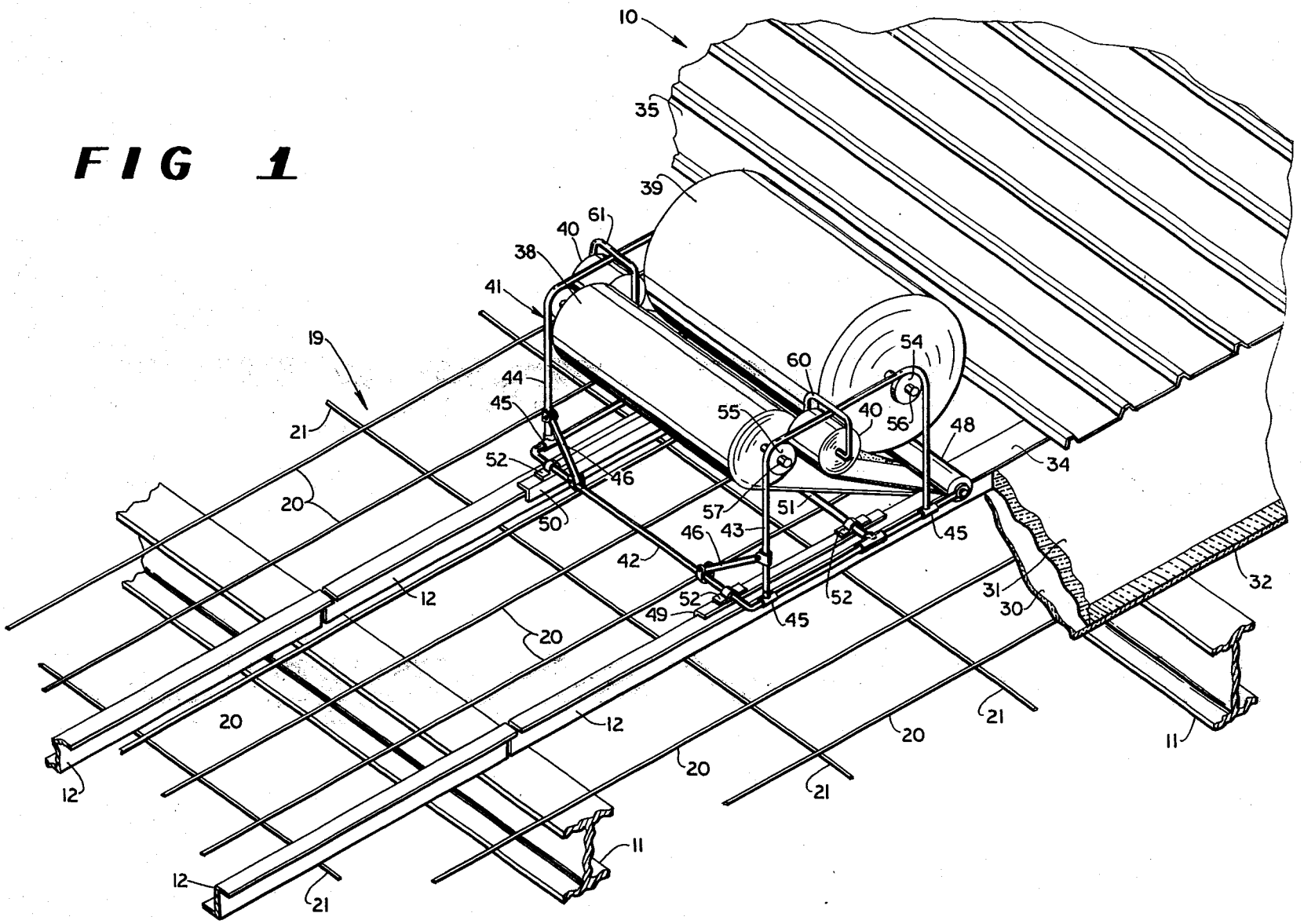
FIG. 1 is a perspective view of a partially completed roof structure and the reel of insulation material and the reel support framework for applying the insulation material to the roof structure, showing the manner in which the insulation material is applied to the roof structure.

Referring now in more detail to the drawing, in which like numerals indicate like parts throughout the several views, FIG. 1 shows a partially completed roof structure 10 which includes a plurality of rafters 11 which are positioned parallel to one another and equally spaced along the length of the building. The rafters 11 are usually inclined and peaked (not shown) at the centerline of the building. A plurality of purlins 12 extend along the length of the building, across the lengths of the rafters. Each purlin 12 usually extends between adjacent ones of the rafters 11, and the purlins are mounted on the rafters. Purlins 12 are approximately Z-shaped (FIG. 5) and include central web 13, upper flange 14 extending in one direction from web 13, and lower flange 15 extending in the opposite direction from web 13. The upper and lower flanges 14 and 15 have their edges 16 and 17 bent further back toward central web 13 to form rims or minor flanges. The configuration of purlin 12 is such that relatively thin light material can be used to fabricate the purlin and the purlin retains enough strength to form adequate support in the roof structure.

In the embodiment illustrated, each purlin 12 is connected at its ends to adjacent ones of the rafters 11, and the purlins 12 are parallel to one another and each purlin extends in a horizontal attitude.

Figure 4:
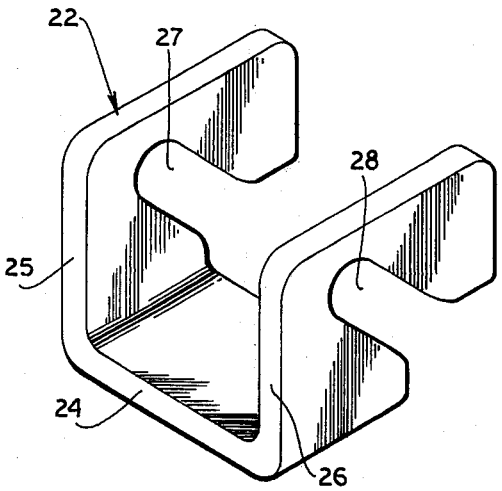
FIG. 4 is a perspective view of the clip that supports the support straps from the purlins.
Figure 5:
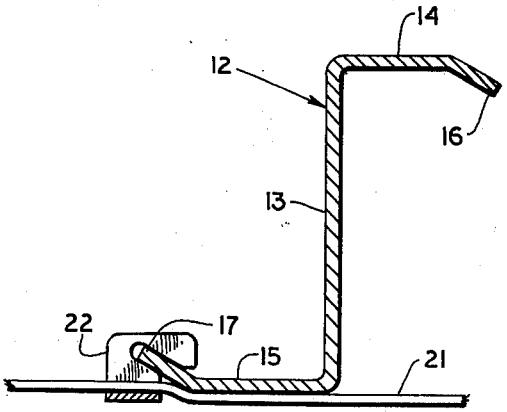
FIG. 5 is an end view of a purlin showing the manner in which the clips mount the support straps from the purlins.

As is shown in FIG. 1, a lattice 19 of metal straps is positioned over the rafters 11. The lattice 19 includes insulation support straps 20 which extend across rafters 11 and are located between and parallel to purlins 12. Cross straps 21 extend across and beneath support straps 20. As is illustrated in FIG. 5, cross straps 21 are connected to purlins 12 by means of clips 22. Each clip (FIG. 4) is U-shaped and includes base leg 24 and side legs 25 and 26. Side legs 25 and 26 are longer than base leg 24, and slots 27 and 28 are formed in side legs 25 and 26 and are angled upwardly in the side legs from base leg 24. The slots 27 and 28 are of a width approximately equal to the thickness of the material which forms purlin 12, and the angles which slots 27 and 28 make with base leg 24 are approximately equal to the angle of the rim 16 or 17 of each purlin with respect to its upper or lower flange 14 or 15. The clips 22 are mounted on the purlins 12 by inserting the angled slots 27 and 28 of each clip over the rim of the purlin, as shown in FIG. 5. The straps 21 are extended beneath the purlins and into the clips, over the base leg 24 and between the side legs 25 and 26 of the clips. The dimensions of each clip are such that the straps 21 must bend slightly to pass around the lower surface of each purlin and then extend upwardly over the lower or base leg 24 of each clip, causing substantial frictional engagement between the straps 21 and the purlins and the clips.

Figure 2:
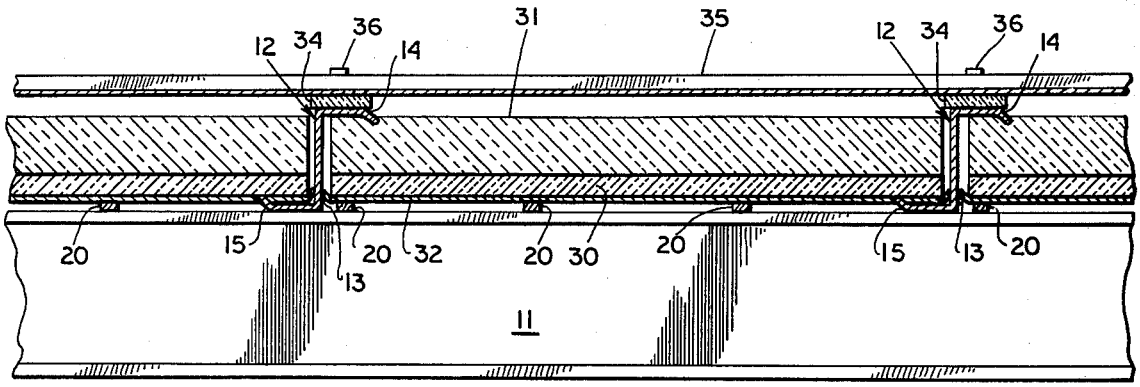
FIG. 2 is a side elevational view of a portion of the completed roof structure.
Figure 3:
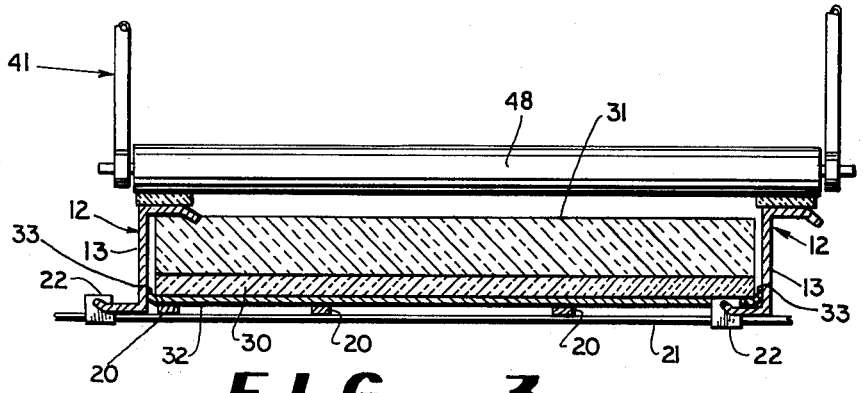
FIG. 3 is an end view of a portion of the roof structure, showing a portion of the reel support framework.

As is illustrated in FIG. 2, insulation material is placed on the lattice of straps. The insulation material can comprise one or more strips or bats of material, and the thickness of the insulation material can vary. In the embodiment illustrated herein, the insulation material comprises two layers of strips of material, including a lower layer 30 and an upper layer 31. The lower layer 30 includes a layer of vapor impermeable substance such as a vinyl sheet 32 applied to the lower surface of the lower layer which is positioned to contact the lattice 19 of straps. The vinyl sheet 32 is wider than the layer of insulation material and the side edges 33 of the vinyl sheet protrude beyond the insulation material and bend upwardly and seal against the central webs 13 of the purlins. The lower layer 30 is thinner than the upper layer 31, and both layers are of a width sufficient to reach substantially between the central webs 13 of adjacent purlins 12. Additional strips 34 of insulation material are placed on the upper flanges 14 of the purlins. Hard roofing material 35 is placed over the purlins and the strips of insulation material 34 and connected thereto by conventional means, such as by rivets 36. The strips 34 of insulation material function as conduction heat insulators between the hard roofing material 35 and the purlins 12, and the lower and upper layers 30 and 31 of insulation material function as convection and radiation insulators between the hard roofing material and the elements therebelow.

As is illustrated in FIG. 1, the lower and upper strips 30 and 31 of insulation material as well as the purlin insulation material 34 are provided in reels 38, 39 and 40, and a reel support framework 41 is provided for mounting the reels of insulation material on adjacent ones of the purlins 12. Framework 41 comprises a U-shaped base 42, inverted U-shaped sides 43 and 44 connected to the U-shaped base 42 by means of clamps 45, side braces 46, roller 48, guides 49 and 50, and strut 51. Sides 43 and 44 are pivotal with respect to U-shaped base 42 by means of the clamp 45, and the side braces 46 function to releasably support the sides in an upright attitude or to allow the sides to be folded over and collapsed in an attitude parallel to the U-shaped base for storage and transportation. Guides 49 and 50 are connected to U-shaped base 42 and to strut 51 by means of U-shaped mounting brackets 52, and the brackets 52 allow the guides 49 and 50 to be moved toward or away from each other in situations where the spacing between purlins 12 is not uniform. Guides 49 and 50 are substantially L-shaped in cross section, with each guide including a downwardly extending leg arranged to move between adjacent ones of the purlins and a laterally extending leg arranged to slide on the top surface of the purlins.

The inverted U-shaped sides 43 and 44 each include bearings 54 and 55, and reel support rods 56 and 57 are arranged to extend through the bearings. Roller 48 is freely rotatable and is of a length sufficient to span over the upper surfaces of adjacent ones of the purlins 12. The width of the strips of insulation material is approximately equal to the distance between the central webs 13 of adjacent purlins 12, and the free ends of the reels 38 and 39 extend downwardly from the reels beneath the roller 48. The roller 48 functions to urge the lower and upper strips of insulation material between the adjacent purlins and down into the space defined between the purlins and over the lattice 19 of straps.

Reel brackets 60 and 61 are mounted on the upper portion of inverted U-shaped sides 43 and 44. Reel brackets 60 and 61 are also of inverted U-shaped configuration with the ends of their side legs extending inwardly toward each other. The reels 40 of purlin insulation are mounted in brackets 60 and 61, and the free ends of the strips of insulation from reels 40 are also fed downwardly from the brackets beneath roller 48. The reels 40 are located approximately above the purlins 12 so that the reels will pay out their insulation onto the upper surfaces of the purlin.

When the rafters and purlins have been placed in the roof structure and the roof is ready to receive its insulation and hard roofing material, a lattice 19 of straps 20 and 21 is formed, by extending the support straps 20 across the rafters 11 and by extending the cross straps 21 beneath the support straps 20. The U-shaped clips 22 are inserted from beneath the cross straps 21 and slipped over the rims 17 of the purlins (FIG. 5). The straps 20 and 21 are placed under tension, and the clips 22 lift the cross straps 21 up into abutment with the lower surfaces of the purlins.

A plurality of reel support frameworks 41 are mounted on adjacent ones of the purlins 12. The relatively thin lower layers of insulation material 30 are supplied in the forms of reels 38, and the reels 38 are mounted on the framework 40 by extending the support rods 57 through the reels and then extending the support rods through the bearings 55. The relatively thick upper layer 31 of insulation material is supplied in reels 39, and these reels are also mounted on the frameworks 41. The reels of purlin insulation material 40 are hung in their brackets 60 and 61 on each framework.

As the workmen form the roof structure, each framework 41 is pushed out on the purlins 12, by sliding the frameworks on their guides 49 and 50 on the purlins, and the workmen apply the hard roofing material 35 behind the frameworks. As the frameworks are moved along the purlins, the reels 38, 39 and 40 of insulation material pay out into the roof structure. The roller 48 of each framework urges the relatively wide strips from the reels 38 and 39 down between the purlins onto the lattice 19, and the narrow strips from reels 40 at the sides of the framework are urged by the roller 48 onto the upper flanges 14 of the purlins.

Since the relatively thick insulation material is present in reel 39, reel 39 must be replaced on the framework 41 more frequently than the other reels of insulation material. Reel 39 is located closer to the hard roofing material 35 in the normal procedure of applying the material to the roof structure, so that the reel of insulation material that must be replaced most frequently is also the reel which is most convenient to replace.

It will be understood by those skilled in the art that the number of layers of insulation material and the type of insulation material can be varied, and although the support straps and cross straps have been described as being formed in a lattice which includes a crisscross of straps, the lattice can be formed with only the support straps or only the cross straps or by another structural arrangement. Moreover, the configuration of the reel support framework 41 and the clip 22 can be varied. Generally, while this invention has been described in specific detail with particular reference to preferred embodiments thereof, it will be understood that variations and modifications can be effected within the spirit and scope of the invention as described hereinbefore and as defined in the appended claims.

I claim:

1. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and at least one laterally extending lower flange, the improvement therein of a plurality of support straps oriented parallel to one another and parallel to said purlins and resting on said rafters between said purlins, elongated strips of insulation material of a width sufficient to substantially span the space between the central webs of adjacent ones of said purlins positioned between and extending parallel to said purlins and resting on said support straps and on the lower flanges of said purlins, and sheets of roofing material mounted on said purlins and extending over said strips of insulation material.

2. The roof structure of claim 1 and further including a plurality of cross straps extending across and beneath said support straps and supported by said purlins whereby said support straps are supported by said cross straps.

3. The roof structure of claim 1 and wherein said elongated strips of insulation material positioned between said purlins comprises a lower layer of insulation material with a bottom surface comprising a vapor impermeable substance, and an upper layer of insulation material of greater thickness than said lower layer resting on said lower layer.

4. A method of applying a roof to a building of the type including inclined parallel rafters and a plurality of purlins mounted on and extending across the rafters with an upwardly extending central web and at least one lower flange comprising forming a lattice of straps over the rafters, supporting reels of elongated insulation material of a width greater than the distance between adjacent ones of the purlins from adjacent ones of the purlins, intermittently moving the reels of insulation along the purlins and paying out the insulation material from the reels and urging the insulation material downwardly between the purlins and into the space between the upwardly extending central webs of the adjacent purlins and onto the lattice of straps between the purlins and onto the lower flanges of the purlins with the lengths of the strips extending parallel to the purlins, and applying roofing material to the purlins over the strips of insulation material.

5. The method of claim 4 and further including the step of connecting some of the straps in the lattice of straps to the purlins.

6. The method of claim 4 and further including the step of placing insulation material on the upper surfaces of the purlins before the roofing material is applied to the purlins.

7. In a roof structure comprising a plurality of spaced rafters oriented parallel to one another, a plurality of approximately equally spaced purlins mounted on said rafters and oriented parallel to one another and perpendicular to said rafters, said purlins being approximately Z-shaped in cross section and including an upwardly extending central web and a laterally extending lower flange, the improvement therein of a plurality of support straps oriented approximately parallel to one another and approximately parallel to said purlins and resting on said rafters between adjacent ones of said purlins in approximately the same plane as the laterally extending lower flange of the purlins with a support strap positioned closely adjacent and on the side of the purlins that have their laterally extending lower flange extending in the opposite direction, elongated strips of insulation material positioned between and extending parallel to the lengths of said purlins and resting on said support straps, the width of said strips of insulation material being sufficient so that the strips of insulation material extend across and are supported at their edges by the laterally extending lower flange of one purlin and the support strap positioned closely adjacent the next adjacent purlin, and sheets of hard roofing material mounted on said purlins and extending over said strips of insulation material.

8. In a roof structure comprising a plurality of spaced rafters oriented parallel to one another, a plurality of approximately equally spaced purlins mounted on said rafters and oriented parallel to one another and perpendicular to said rafters, said purlins being approximately Z-shaped in cross section with an upwardly extending central web and oppositely laterally extending upper and lower flanges, the improvement therein of a plurality of support straps oriented parallel to one another and parallel to said purlins and resting on said rafters between said purlins, elongated strips of insulation material of a width sufficient to substantially span the space between the central webs of adjacent ones of said purlins positioned between and extending parallel to said purlins and resting on said support straps and on the lower flanges of said purlins, and sheets of roofing material mounted on said purlins and extending over said strips of insulation material, said strips of insulation material being of a thickness approximately equal to the height of the purlins and substantially filling the space between said support straps and said sheets of roofing material.

* * * * *